US010591193B2

(12) United States Patent
Erkan et al.

(10) Patent No.: US 10,591,193 B2
(45) Date of Patent: Mar. 17, 2020

(54) WATER-GUIDING COMPONENT ASSEMBLY FOR A HOUSEHOLD COOLING APPLIANCE

(71) Applicant: BSH-HAUSGERATE GMBH, Munich (DE)

(72) Inventors: Enis Sinan Erkan, Istanbul (TR); Dogan Kilinc, Istanbul (TR); Cengizhan Kuecuekarslan, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 160 days.

(21) Appl. No.: 15/652,306

(22) Filed: Jul. 18, 2017

(65) Prior Publication Data

US 2018/0023869 A1 Jan. 25, 2018

(30) Foreign Application Priority Data

Jul. 19, 2016 (TR) ..... 2016/09956

(51) Int. Cl.

| | |
|---|---|
| ***F25B 41/00*** | (2006.01) |
| ***F25D 23/12*** | (2006.01) |
| ***B67D 1/00*** | (2006.01) |
| ***B67D 1/08*** | (2006.01) |

(52) U.S. Cl.

CPC ..... *F25B 41/003* (2013.01); *B67D 1/00* (2013.01); *B67D 1/0014* (2013.01); *F25D 23/126* (2013.01); *B67D 1/0888* (2013.01); *B67D 2001/0094* (2013.01); *B67D 2210/0001* (2013.01); *F25D 2323/121* (2013.01)

(58) Field of Classification Search

CPC ..... B67D 1/0014; B67D 2001/0094; B67D 2210/0001; B67D 1/0888; F25B 41/003; F25D 23/126; F25D 2323/121

USPC ..... 137/343, 377

See application file for complete search history.

(56) References Cited

U.S. PATENT DOCUMENTS

| | | | | |
|---|---|---|---|---|
| 2,994,339 | A * | 8/1961 | Massey | F15B 21/02 137/343 |
| 3,726,404 | A * | 4/1973 | Troglione | B67D 3/0029 210/139 |
| 5,193,718 | A * | 3/1993 | Hassell | B67D 1/0888 222/129.1 |
| 5,290,442 | A * | 3/1994 | Clack | B01D 61/08 210/257.1 |
| 5,927,093 | A * | 7/1999 | Noguchi | F24F 1/20 62/259.1 |

(Continued)

FOREIGN PATENT DOCUMENTS

| | | | |
|---|---|---|---|
| DE | 102010002729 | A1 | 9/2010 |
| EP | 1139045 | A2 | 10/2001 |

(Continued)

*Primary Examiner* — Craig M Schneider
*Assistant Examiner* — Jonathan J Waddy
(74) *Attorney, Agent, or Firm* — Laurence A. Greenberg; Werner H. Stemer; Ralph E. Locher

(57) ABSTRACT

A water-guiding component assembly for a household cooling appliance contains a plurality of connection interfaces connecting to units not forming part of the component assembly and/or to components forming part of the component assembly. The component assembly contains an outer housing, in which the connection interfaces are comprised and housed.

15 Claims, 4 Drawing Sheets

(56) References Cited

U.S. PATENT DOCUMENTS

| | | | | |
|---|---|---|---|---|
| 6,158,229 | A * | 12/2000 | Aizawa | F25B 41/003 62/298 |
| 6,412,515 | B1 * | 7/2002 | Hess | G01F 1/34 137/343 |
| 8,640,481 | B2 | 2/2014 | An | |
| 8,938,985 | B2 | 1/2015 | Lim et al. | |
| 2008/0156015 | A1 * | 7/2008 | Meyerholtz | F25D 23/126 62/318 |
| 2008/0264877 | A1 * | 10/2008 | Davis | B67D 3/0009 210/760 |
| 2010/0126210 | A1 * | 5/2010 | Rotter | F25D 23/065 62/441 |
| 2010/0170284 | A1 * | 7/2010 | An | F25D 23/126 62/340 |
| 2010/0275633 | A1 | 11/2010 | An et al. | |
| 2011/0056222 | A1 | 3/2011 | Lee et al. | |
| 2012/0006046 | A1 * | 1/2012 | An | F25D 23/126 62/318 |
| 2014/0223715 | A1 | 8/2014 | Bippus et al. | |
| 2014/0283542 | A1 | 9/2014 | Jang | |
| 2016/0341462 | A1 | 11/2016 | Kim | |

FOREIGN PATENT DOCUMENTS

| | | | |
|---|---|---|---|
| EP | 2407739 | A2 | 1/2012 |
| EP | 2728282 | A2 | 5/2014 |
| EP | 3096097 | A1 | 11/2016 |

* cited by examiner

WATER-GUIDING COMPONENT ASSEMBLY FOR A HOUSEHOLD COOLING APPLIANCE

CROSS-REFERENCE TO RELATED APPLICATION

This application claims the priority, under 35 U.S.C. § 119, of Turkish application TR 2016/09956, filed Jul. 19, 2016; the prior application is herewith incorporated by reference in its entirety.

BACKGROUND OF THE INVENTION

Field of the Invention

The invention relates to a water-guiding component assembly for a household cooling appliance. The component assembly contains a plurality of connection interfaces connecting to units not forming part of the component assembly so that these external units are arranged outside the component assembly.

From the prior art household cooling appliances are known, which contain a dispenser unit. The dispenser unit can be configured for dispensing ice form elements and/or chilled liquids. Commonly it is envisaged here that the household cooling appliance is connected to an external water supply, in particular to a domestic water network, by which the required water reaches the household cooling appliance and from their also the dispenser unit. Such dispenser unit comprises a water-guiding component assembly, in which connection interfaces, in particular also in the form of valves, are arranged, so that in turn the conducting of the water to the individual external units, such as an icemaker or a drink dispenser device of the household cooling appliance is performable again.

This water-guiding component assembly is commonly arranged within a machine space of the household cooling appliance, in which also electronics components are arranged.

In a common design of a water-guiding component assembly due to leakages the leaking of water may occur, in particular splash water may be present, which then can reach the electronics components or splatter them. The functionality of these electronics components can thereby be restricted.

SUMMARY OF THE INVENTION

It is the task of the present invention to provide a water-guiding component assembly, in which an undesired leaking of water, in particular splash water, is avoided.

According to the invention a water-guiding component assembly for a household cooling appliance contains a plurality of mechanical connection interfaces, at which connections to external units, which thus are not parts of the component assembly, can be configured. At these connection interfaces thus also mechanical coupling points are formed, at which an undesired leakage of water conducted in the water-guiding component assembly, can occur. An essential idea of the invention is to be seen in that the water-guiding component assembly contains an outer housing, in which the connection interfaces are housed. By such a housing of the connection interfaces a possibly occurring leakage of water, in particular leakage of splash water, can be contained and an undesired sprinkling of this water to components arranged adjacent to the water-guiding component assembly is prevented. In particular it is thereby also prevented that adjacent other components, in particular electronics components, are not splattered with splash water.

In particular it is envisaged that the outer housing contains at least one opening, through which a connection into the housing that does not form part of the component assembly is insertable for interior connection to a component of the component assembly. The connection formed internally within the housing between the connection not forming part of the component assembly and the component in this sense is a connection interface. By these critical points, at which undesired leakages can occur, and which thus are also mechanical coupling points, being housed in a housing an undesired leaking of water can be contained in the outer housing itself and does not spread in the area surrounding the water-guiding component assembly in an undesired way.

Preferably it is envisaged that a connection interface between two separate components are arranged in the outer housing and belonging to the component assembly. Thereby, it is envisaged that also separate components of the component assembly itself, which are connected with each other, have an undesired water leakage outside the water-guiding component assembly.

Preferably the water-guiding component assembly contains a filter arranged outside the outer housing on the outer housing. Since the filter represents a component of the water-guiding component assembly, which would need to be housed with regard to an undesired splash water leakage, same is arranged outside this outer housing. Thereby the outer housing can be set up to be more compact, and an access to the filter is facilitated also without opening the outer housing.

Preferably it is envisaged that the water guiding assembly contains a filter housing for the filter. The filter housing is especially arranged outside the outer housing, but connected with the outer housing. Preferably the filter housing contains at least two separate housing parts, a first filter housing part and a second filter housing part. Especially both filter housing parts are shaped tube-like. Preferably the first filter housing part is integrally formed with a part of the outer housing. By this configuration the filter can be securely positioned. By the tube-like formation of the holding device being configured to be integrated within the outer housing, also the number of components is reduced and a correspondingly simple manufacturing of the outer housing, in particular as injection-molded component, is facilitated.

Preferably it is envisaged that the outer housing contains a filter opening, through which a connection hose is passed, by which a component in the outer housing is connected with the filter in a fluid-conducting way and especially with the first filter housing part, thus connected with the filter in the filter housing. In this regard, too, in particular a connection interface is configured, in which then in particular this arrangement of the connection hose is individually envisaged and guided into the outer housing, in order to then connect it with a component of the component assembly in the interior of the outer housing. This housing-internal connection between the connection hose and the component thus equally represents a connection interface. By same being also arranged within the outer housing, water leaking at this specific coupling point cannot reach components not forming part of the component assembly and cannot splatter them.

Preferably it is envisaged that the water-guiding component assembly has at least two valves, which are arranged in the outer housing and at respective connection interfaces are connected with further components of the component assembly and/or with components not forming part of the component assembly. Also these connection interfaces are arranged within the outer housing. Thereby the very connection interfaces are especially protected by valves and particularly critical areas, which by opening and closing of the valves cause a seeping of water or a leakage, possibly even permanently, can thus be correspondingly protected.

Preferably it is envisaged that the outer housing is configured to consist of several parts. This is particularly advantageous since thus the mounting of the components of the component assembly to be arranged within the outer housing is rendered easier. Also accessibility is thereby improved, since the outer housing can also be disassembled and reassembled in a non-destructively releasable way. Thus for service or exchange operations the outer housing is reversibly disassembled and reassembled again.

Preferably it is envisaged that the outer housing contains a first housing part and a second housing part, wherein the housing parts in the assembled state bound the interior of the outer housing. With only separate housing parts being provided here, the above-named advantages are achieved without comprehensive mounting effort being required for disassembling and assembling of the outer housing. A simple and fast assembly and disassembly of the outer housing is thereby achieved.

Preferably it is envisaged that the two housing parts are connected in a non-destructively releasable way. In particular here for instance a latching can be envisaged. This is a mechanically stable connection, which can also be easily brought into its locked final state. Moreover in a latching the assembled final state is automatically achieved when assembling the housing parts and no additional assembly steps need to be performed. An incorrect assembly of the housing parts is thereby also avoided.

In particular it is envisaged that the first housing part in the connected state with the second housing part with a basic body up to a stop formed on the basic body is fully plunged into a basic body of the second housing part. The two housing parts by this design are thus quasi maximally pushed into each other. Thereby the stability of the position of the housing parts relative to each other is improved and thus also the overall stability of the outer housing enhanced. Moreover by this design the assembled final position is securely reached, since by the relatively far insertion of the housing parts into each other also a certain guidance for achieving the assembled end position is formed. By the stop it is also avoided that the housing parts are assembled incompletely and that thus the assembled final position is not reached. By the formation of a stop thus upon mounting also a quasi haptic feedback for the assembler is achieved to recognize the assembled final position.

Preferably on the basic body of the first housing part at least one housing socket protruding in a tube-like way from the basic body is integrated and thus integrally formed with it, wherein this housing socket on its end facing away from the basic body has an opening. By such a design the passing-through of components, which then are to be connected with components forming part of the component assembly, can be improved. Such housing socket allows for a very exposed positioning of components forming part of the component assembly within the outer housing so that also a coupling or insertion of components not forming part of the component assembly is then allowed to be effected in an easier and more targeted way. The coupling and thus the connection between components forming part of the component assembly and components not forming part of the component assembly in the interior of this housing socket can then also be effected securely in a very targeted way.

A connection interface between a component forming part of the component assembly and a component not forming part of the component assembly is then formed in the interior of the housing socket.

Preferably it is envisaged that the outer housing contains a first cover cap, which is arranged in a non-destructively releasable way on the end of the housing socket facing away, and which opposite the opening of the housing socket comprises a cap opening with reduced cross-section. This is a further very advantageous embodiment, since thus by the in particular separate cover cap a further protection against undesired leakage of water, in particular of splash water from the outer housing is achieved. In particular from the opening on the housing socket thus this undesired leakage of splash water is prevented, since by this cover cap the opening cross-section is minimized. In particular by this cover cap a reduction in cross-section of the socket opening is effected in such a way that a component to be inserted from the outside can be passed preferably precisely fitting through this cap opening. Thus the cover cap with its cap opening of reduced cross-section is also designed such that a component to be passed through from the outside directly contacting the walls bounding the cap opening and thus quasi also a kind of sealing is provided. Additionally by this design it is also achieved that then a certain mechanical support and retention is achieved by the cover cap for the external component to be passed through.

Preferably it is envisaged that on the basic body of the second housing part at least one housing socket protruding tube-like from the basic body and having an opening on its end facing away from the basic body, is integrated. Here the corresponding advantages as they have already been named for the other embodiment apply in analogy.

In particular it is envisaged that the outer housing contains a second cover cap, which is arranged to be non-destructively releasable on its end of the housing socket that faces away, and which contains a cap opening with reduced cross-section in comparison with the opening of the housing socket. Here, too, the already named advantageous embodiments apply.

In particular it is envisaged that on the inner side of the at least one wall of the first housing part of the outer housing positioning bars for positioning a component of the component assembly is integrated in the interior of the first housing part and/or on an inner side of at least one wall of the second housing part positioning bars for positioning a component of the component assembly in the interior of the second housing part are integrated. This is a further very advantageous embodiment, since thus the outer housing itself contains corresponding holding devices for components of the component assembly, which are arranged within the outer housing. An undesired shifting of these components out of place is thus prevented.

In a further advantageous embodiment it is envisaged that on an outer surface of a housing part, in particular on a bottom of the housing part, a holding element is arranged, in particular integrally formed with it, with which the outer housing can be attached to a component not forming part of the component assembly. In particular this element is configured as a lug, and thus quasi an inserting or latching-in of the outer housing on this component not forming part of the component assembly can be envisaged.

Preferably several such elements are formed on this outer surface, in particular the bottom of the housing part.

It may be envisaged that the outer housing then additionally also is otherwise attached to the component not forming part of the component assembly, for instance is additionally screwed on.

Preferably the water-guiding component assembly is preferably arranged in a household cooling appliance. In this connection it can be envisaged that the household cooling appliance comprises a dispenser unit for ice form elements and/or chilled liquids. The water-guiding component assembly is connected with a water line leading externally to the household cooling appliance. By the water-guiding component assembly the water is conducted to a dispenser unit, which is formed for producing ice form elements and/or for dispense.

The invention also contains a household cooling appliance containing such water-guiding component assembly. The household cooling appliance is also configured for storing and preserving food and can for instance be a cooling appliance or a freezer or a fridge/freezer combination device. The household cooling appliance contains a dispenser unit, which is configured for dispensing ice form elements and/or chilled liquids. The dispenser unit in this context can be arranged with at least one dispenser element on the door of the household cooling appliance and can be accessible from the outside in the closed state of the door, in order to dispense corresponding dispense media.

Preferably the household cooling appliance is a rack-mounted model. In particular it can be arranged in a furniture niche of a furniture wall.

With the indications "top", "bottom", "front", "rear", "horizontal", "vertical", "depth direction", "width direction", "height direction" etc. the positions and orientations given for intended use and intended arrangement of the appliance and for a user then standing in front of the appliance and viewing in the direction of the device are indicated.

Further features of the invention derive from the claims, the figures, and the description of the figures. The aforementioned features and feature combinations named in the description, as well as the features and feature combinations named in the following in the description of the figures and/or shown in the figures alone can be used not only in the respective indicated combination, but also in other combinations, without departing from the scope of the invention. Thus also embodiments of the invention are to be considered as comprised and disclosed, which are not explicitly shown and explained in the figures, but by separated feature combinations derived from the explained embodiments and can be generated therefrom. Thus also explanations and feature combinations are to be regarded as disclosed, which thus do not comprise all features of an originally formulated independent claim. Moreover embodiments and feature combinations, in particular by the embodiments set out in the above, are to be considered as disclosed, which go beyond the feature combinations set out in the back-references of the claims or deviate therefrom.

Other features which are considered as characteristic for the invention are set forth in the appended claims.

Although the invention is illustrated and described herein as embodied in a water-guiding component assembly for a household cooling appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the figures same elements and elements having the same function are equipped with the same reference signs.

Figure 1:
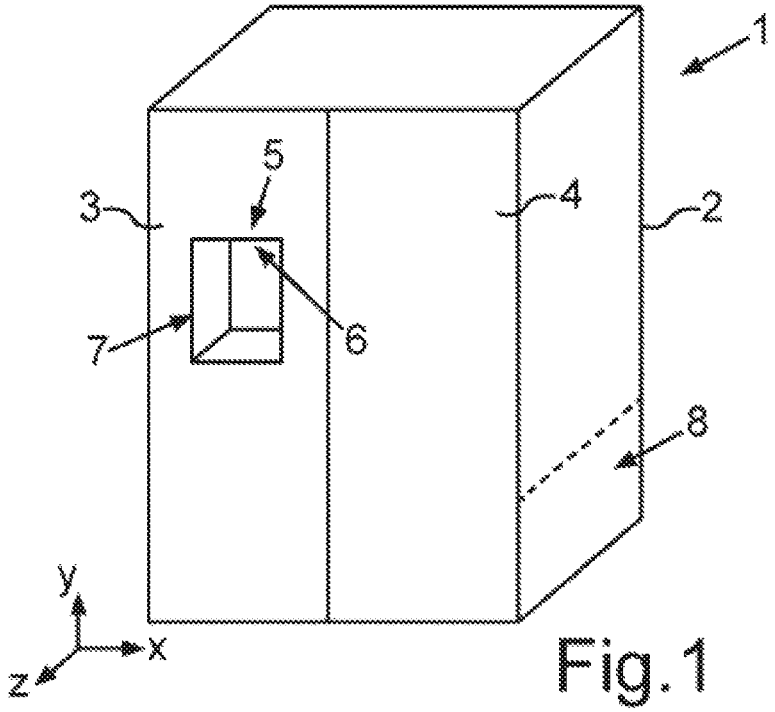
FIG. 1 is a diagrammatic, perspective view of a household cooling appliance.

Referring now to the figures of the drawings in detail and first, particularly to FIG. 1 thereof, there is shown a schematic view a household cooling appliance 1 is shown, which is configured for storing and preserving food items. The household cooling appliance 1 can be a cooling appliance or a freezer or a fridge/freezer combination device. The household cooling appliance 1 is preferably a rack-mounted model. The household cooling appliance 1 has a housing 2, in which at least one receiving space for food items is configured. In the embodiment, to be understood merely as an example, the household cooling appliance 1 contains two doors 3 and 4, which close the at least one receiving space at the front, and which can be opened and closed independently of each other, and for this purpose are each pivotable about a vertical axis orientated in the height direction and thus in the y direction. In the embodiment moreover a dispenser unit 5 is arranged in the door 3 and at the front and thus is also accessible when the door 3 is closed. The dispenser unit 5 is configured for dispensing ice form elements, such as for instance ice cubes and/or crushed ice, and thus can additionally or instead also be configured for dispensing chilled drinks. The dispenser unit 5 in this connection contains a dispenser element 6, via which the ice form elements and/or the chilled liquid can be dispensed. Moreover, in this connection a niche 7 is formed on the front side and thus accessible from the front, in which a receiving vessel can be inserted, in order to be able to contain the media dispensed by the dispenser element 6.

The household cooling appliance 1 moreover contains a machine space 8 formed in the bottom portion of the household cooling appliance 1.

Figure 2:
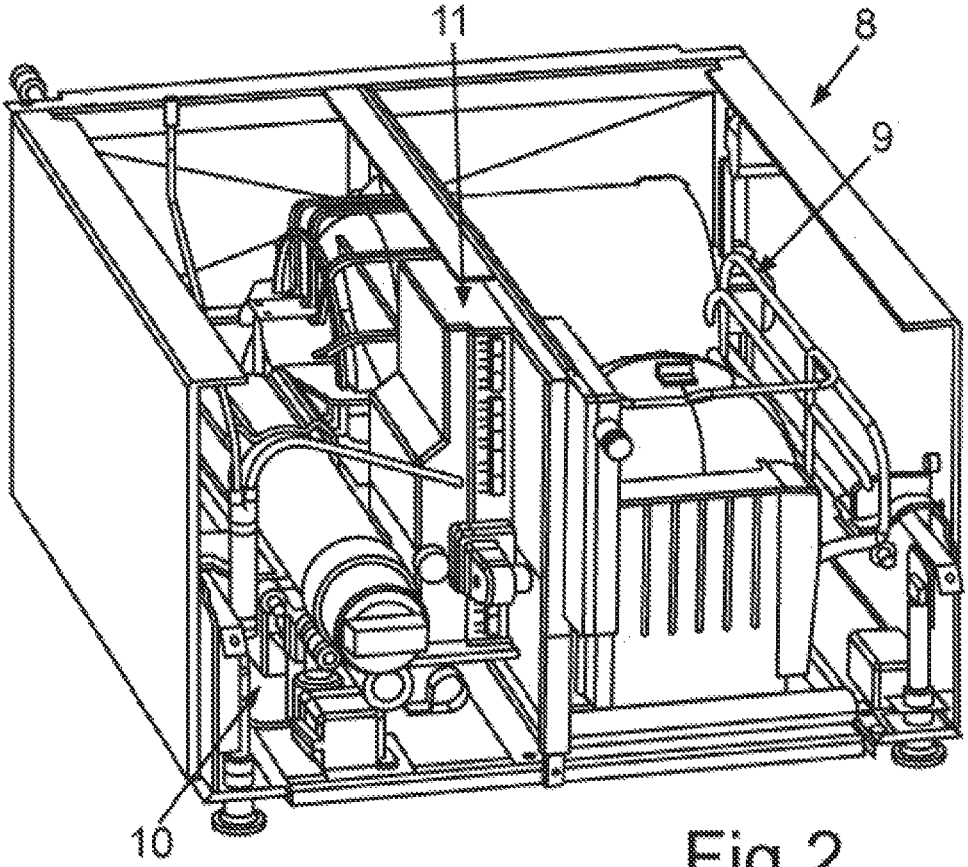
FIG. 2 is a perspective view of partial areas of the household cooling appliance according to FIG. 1.

In FIG. 2 the machine space 8 is shown in a perspective view. In the machine space 8 components of a cooling circuit 9 of the household cooling appliance 1 are arranged. Moreover, in this machine space 8 also a water-guiding component assembly 10 is arranged. The water-guiding component assembly 10 is connected to a domestic water network external to the appliance so that water of the domestic water network reaches the household cooling appliance 1 and is further taken through this water-guiding component assembly 10 to the dispenser unit 5. Adjacent to the water-guiding component assembly 10 is arranged an electronics component 11. Moreover also further electronics components 11 are arranged in the machine space 8 adjacent to the water-guiding component assembly 10.

Figure 3:
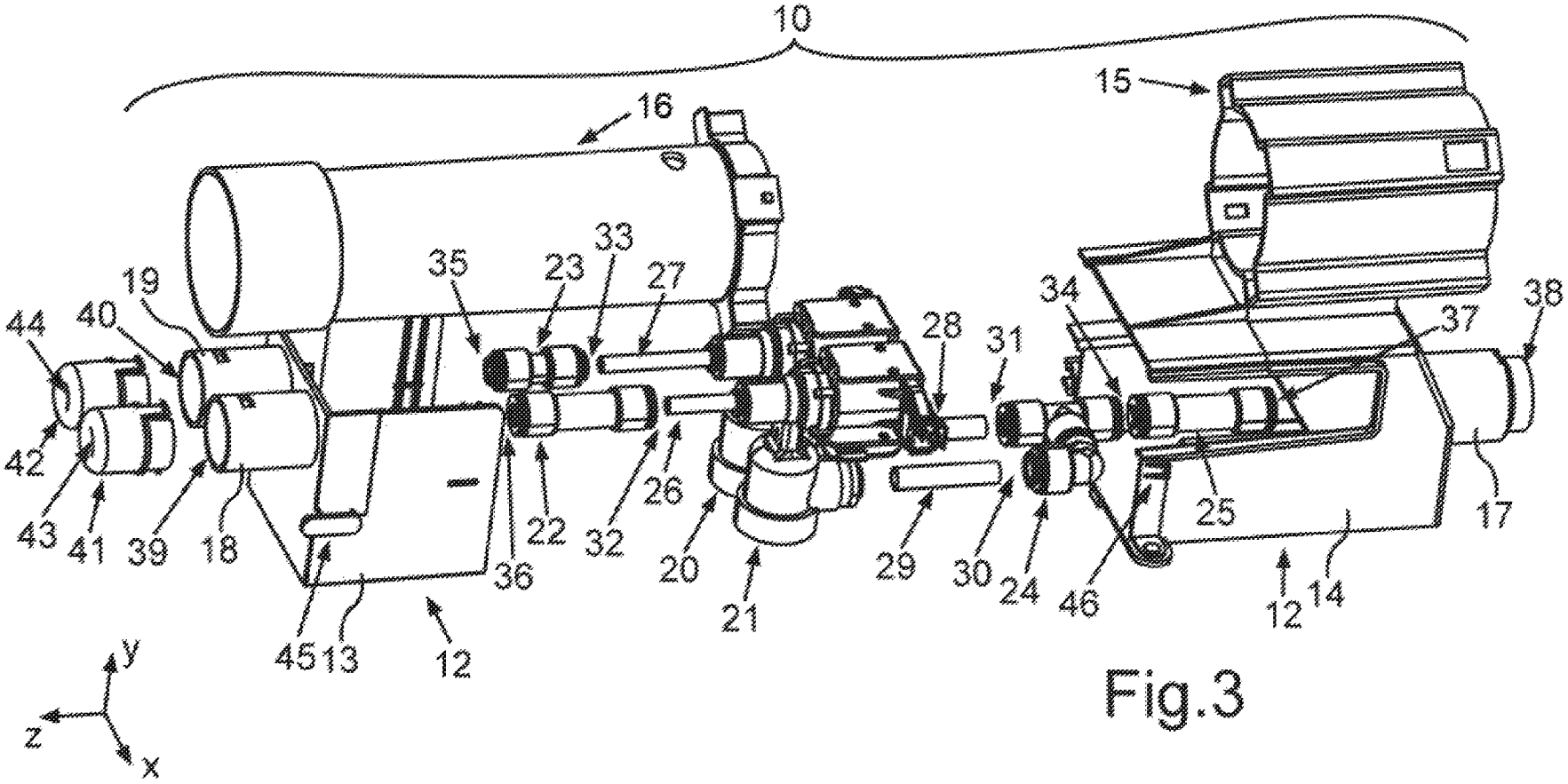
FIG. 3 is an exploded, perspective view of an embodiment of a water-guiding component assembly according to the invention.

In FIG. 3 the water-guiding component assembly 10 is shown in an embodiment in an exploded view. The water-guiding component assembly 10 contains an outer housing 12, which contains a first housing part 13 and a second housing part 14. The two separate housing parts 13 and 14 are non-destructively releasable and thus capable of being reversibly assembled and disassembled again. Moreover, the water-guiding component assembly 10 contains a filter housing for a filter 64, through which water is drained. Preferably the filter housing contains a first filter housing part 15 and a separate second filter housing part 16. The preferably tube-like housing parts 15, 16 are configured for holding the filter 64. Especially the first filter housing part 15 is, in particular, integrally formed, on the outer housing 12, in particular the second housing part 14.

On the second housing part 14 moreover a housing socket 17 is integrally formed, which is formed upon the side wall facing away from the second housing part 14.

Moreover, the first housing part 13 contains two housing sockets 18 and 19, which are equally formed in particular as a single piece, in particular upon the second side wall facing away from the second housing part 14.

The water-guiding component assembly 10 moreover contains a plurality of functional components, which are configured for conducting the water. In this connection in the embodiment two valves 20 and 21 are envisaged, which are magnetic valves. Moreover, in the embodiment a further valve 22 and a connector 23 is provided, which in the mounted state extends into the housing sockets 18 and 19. Moreover a T-piece 24 is provided, which in turn is connected with a further valve 25. The valves 20, 21, 22, and 25 are connected with each other via further components 26, 27, 28, 29. Between every correspondingly named connection point of the individual components, there are connection interfaces formed. However, connection interfaces 30, 31, 32, 33, 34 are here named as examples. Moreover, also further connection interfaces 35, 36, and 37 are present, which are configured as connections between components forming part of the component assembly and components not forming part of the component assembly. The further named connection interfaces 30 to 34 represent connection interfaces between individual components forming part of the component assembly.

In the mounted state and thus in the assembled state of the water-guiding component assembly 10 all of the named connection interfaces 30 to 37 are arranged within the outer housing 12 and thus enclosed and correspondingly protected.

Depending on how the dispenser unit 5 is configured, and thus whether it is configured merely for dispensing ice form elements or merely for dispensing chilled liquids or for dispensing both media, the design of the water-guiding component assembly 10 is individually designed. This means that depending thereon for instance then only the housing socket 18 or only the housing socket 19 is provided and in this connection then for instance also only the valve 22 or the connector 23 is provided. In the shown embodiment the dispenser unit 5 is configured both for dispensing ice form elements as well as for dispensing chilled liquid so that the water-guiding component assembly 10 is configured according to the embodiment in FIG. 3. This is because with such a design then the dispenser element for dispensing the chilled liquid is connected with the valve 22 via the housing socket 18. The ice maker is connected via the connector 23 and the housing socket 19 with the water-guiding component assembly 10.

Via the housing socket 17 the first filter housing part 15 and therefore the filter 64 too, is connected with the valve 25. The domestic water network conduit and thus the external water supply is connected with the filter 64.

The outer housing 12 thus contains at least one opening, through which a connection not forming part of the component assembly can be passed into the outer housing 12 for connection to a component of the component assembly 10 positioned within the interior of the outer housing 12, wherein this connection internal to the housing or coupling between the connection not forming part of the component assembly and the components of the component assembly 10 then is a connection interface. These were already set out in the above in exemplary explanations.

Thus at least one connection interface is formed between two components arranged in the outer housing 12, which are separate and belong to the component assembly 10. In the embodiment it is also envisaged that at least one connection interface 35, 36, 37 between a component forming part of the component assembly 10 and a component not forming part of the component assembly 10, wherein also then this connection interface is positioned in the outer housing 12. All connection interfaces 35, 36, 37 are to be understood as of such kind, through which water conducted in the water-conducing component assembly 10, can exit. The openings of the external housing 12 are on the one hand formed by the housing sockets 17, wherein here the opening then is configured as filter opening 38. On the other hand, openings 39 and 40 are envisaged, that are formed on the external housing 12 and are provided by the housing sockets 18 and 19. Through these openings 39 and 40 a connection not forming part of the component assembly or a component not forming part of the component assembly can be passed into the external housing 12 and is configured for connection positioned in the interior of the external housing 12 connecting to a component forming part of the component assembly, in particular the valve 22 and the connector 23, is configured.

It is moreover envisaged that the water-guiding component assembly 10 contains a first cover cap 41 and a second cover cap 42. The separate cover caps 41 and 42 are envisaged for plugging on the housing sockets 18 and 19. They can in particular be latched on them. The cover caps 41, 42 have cap openings 43 and 44, which in comparison with the openings 39 and 40 are reduced in cross-section. These cap openings 43 and 44 thus reduce the cross-section of the openings 39 and 40 of the outer housing 12 and thus in particular of the housing sockets 18 and 19.

Moreover it is envisaged that on the first housing part 13 a connection element or fastening element 45 is formed as a single piece, which in particular is configured for latching-in with the counter element or the fastening element 46 formed on the second housing part 14. On the opposite side of the housing parts 13 and 14 once again corresponding elements 45 and 46 are envisaged.

Figure 4:
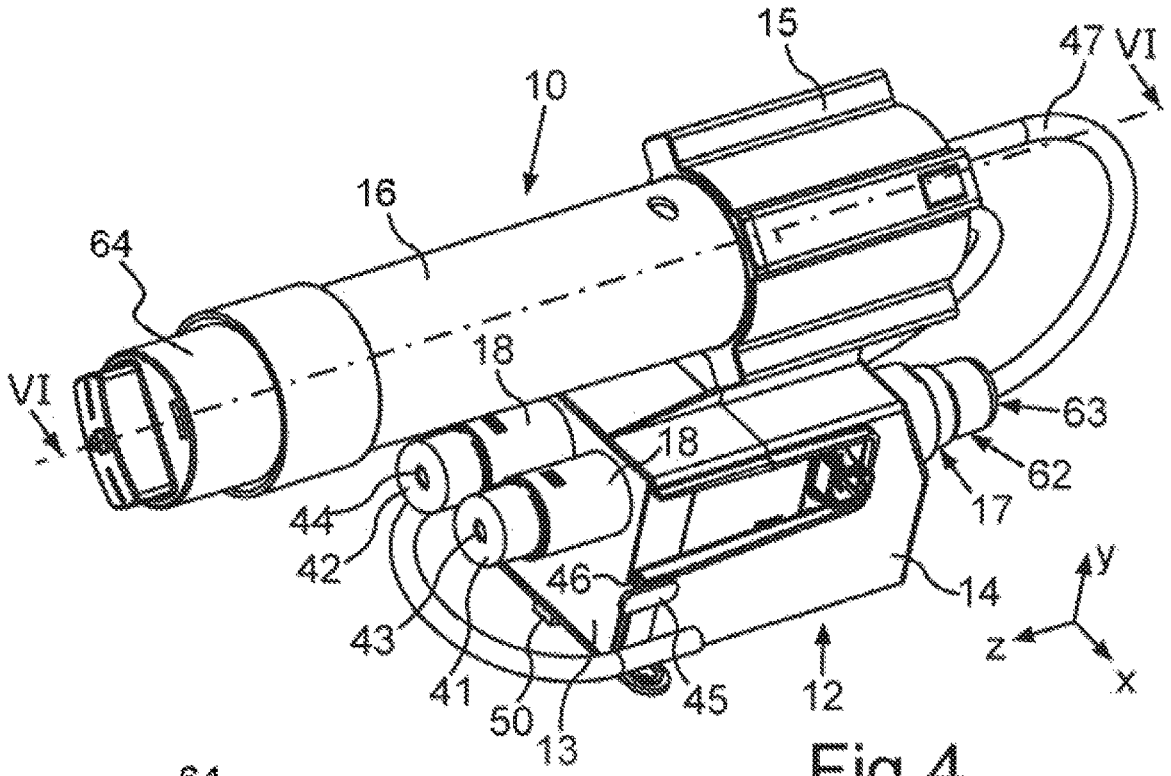
FIG. 4 a first perspective view of an embodiment of a water-guiding component assembly according to the invention.

In FIG. 4 the water-guiding component assembly 10 is shown in the assembled state. It can be seen that a connection hose 47 is arranged between the first filter housing part 15 and the outer housing 12. The connection hose 47 extends via the filter opening 38 into the housing socket 17 and therein is connected with the valve 25 via the connection interface 37.

In FIG. 4 also the latched-in state between the elements 45 and 46 is shown. The cover caps 41 and 42 are plugged upon the housing sockets 18 and 19 and thus are latched.

Figure 5:
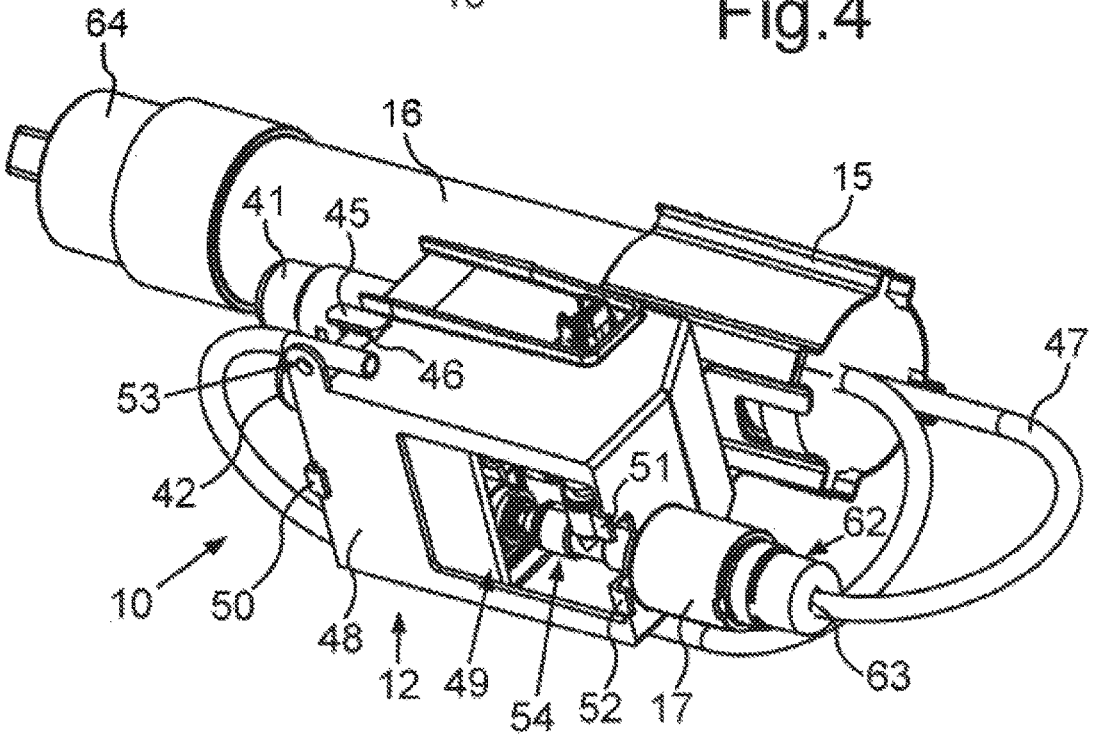
FIG. 5 a perspective view of the component assembly according to FIG. 4 in a perspective that is different therefrom.

In FIG. 5 the water-guiding component assembly 10 is shown in a perspective that is different from FIG. 4. It can here be recognized that on a bottom wall 48 of the outer housing 12, in particular the second housing part 14 a bottom opening 49 is configured. The water-guiding component assembly 10 is arranged with this bottom wall 48 on a component not forming part of the component assembly, in particular fastened to it on a bottom of the machine space 8. For this fastening it is envisaged that in particular on this bottom wall 48 several fastening elements 50, 51, and 52 are formed as a single piece. These fastening elements 50 to 52 are configured in the embodiment as holding lugs engaging with corresponding recesses in the bottom of the machine space 8. Additionally it is preferably envisaged that the outer housing 12 is also screwed to this bottom and therefore at least one lug is integrally formed with at least one screw passage 53. In FIG. 5 also the interior 54 of the outer housing 12 can be viewed.

Figure 6:
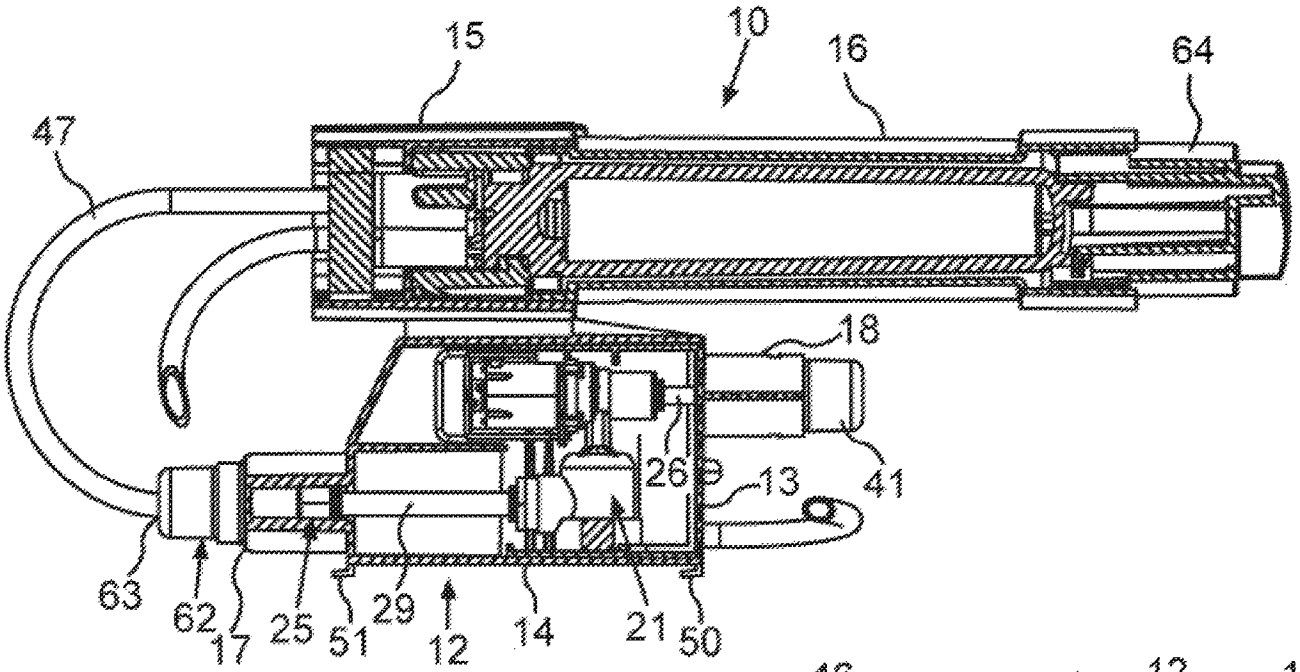
FIG. 6 is a vertical sectional view of the water-guiding component assembly according to FIG. 4 and FIG. 5.

In FIG. 6 in a vertical sectional view along the intersection line VI-VI in FIG. 4 the water-guiding component assembly 10 is shown. The arrangement of the components belonging to the component assembly 10 can be recognized in the outer housing 12.

Figure 7:
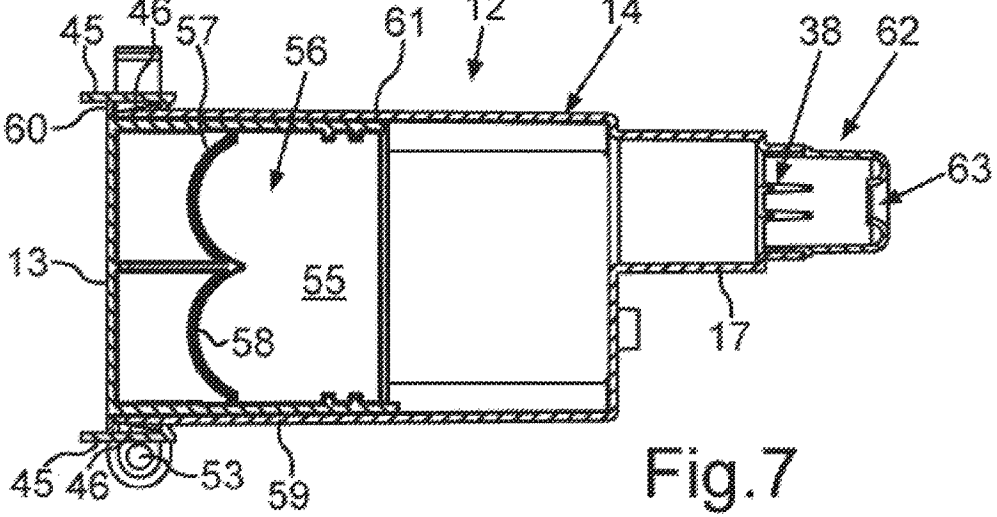
FIG. 7 is a horizontal sectional view through a housing of the water-guiding component assembly according to FIG. 4 to FIG. 6.

In FIG. 7 in a horizontal sectional view and thus in a sectional plane corresponding to the x-z plane the outer housing 12 is shown in the assembled final state. As can also be seen here, in particular on the first housing parts 13 on several inner sides, preferably on an inner side 55 of a bottom wall 56 of the first housing part 13 positioning bars 57 and 58 are integrally formed. These serve as positioning elements and thus also as stops for the valves 20 and 21 in the assembled final state. Thereby no undesired shifting in the depth direction and thus in the z direction can occur. As can be seen in particular in the views according to FIG. 4 to FIG. 7, in the assembled state of the outer housing 12 the first housing part 13 is arranged to be fully plunged with a basic body 59 up to a stop 60 formed on the basic body 59 into a basic body 61 of the second housing part 14.

In FIG. 7 also a separate cover cap 62 is shown, which is slid upon the housing socket 17 and in particular is latched with it. The cover cap 62 has a cap opening 63 that in comparison with the filter opening 38 is reduced in cross-section and through which the connection hose 47 can be passed to fit precisely.

The following is a summary list of reference numerals and the corresponding structure used in the above description of the invention:

1 household cooling appliance
2 housing
3 door
4 door
5 dispenser unit
6 dispenser element
7 niche
8 machine space
9 refrigeration circuit
10 water-guiding component assembly
11 electronics component
12 outer housing
13 housing part
14 housing part
15 first filter housing part
16 second filter housing part
17 housing socket
18 housing socket
19 housing socket
20 valve
21 valve
22 valve
23 connector
24 T-piece
25 valve
26 component
27 component
28 component
29 component
30 connection interface
31 connection interface
32 connection interface
33 connection interface
34 connection interface
35 connection interface
36 connection interface
37 connection interface
38 filter opening
39 opening
40 opening
41 cover cap
42 cover cap
43 cap opening
44 cap opening
45 fastening element
46 fastening element
47 connection hose
48 bottom wall
49 bottom opening
50 fastening element
51 fastening element
52 fastening element
53 screw passage
54 interior
55 inner side
56 bottom wall
57 positioning bar
58 positioning bar
59 basic body
60 stop
61 basic body
62 cover cap
63 cap opening
64 filter

The invention claimed is:

1. A water-guiding component assembly for a household cooling appliance, the water-guiding component assembly comprising:

a plurality of connection interfaces connecting to units not forming part of the water-guiding component assembly and/or to components forming part of the water-guiding component assembly;

a filter having a longitudinal axis; and an outer housing in which said connection interfaces are disposed, said outer housing having a first housing part and a second housing part releasably connected to one another in a direction parallel to the longitudinal axis;

a filter housing part disposed on an outer surface of said outer housing for receiving said filter therein by insertion along the longitudinal axis.

2. The water-guiding component assembly according to claim 1, wherein said outer housing has at least one opening formed therein, by said opening a connector of the unit not forming part of the water-guiding component assembly is insertable in said outer housing for connecting to the component forming part of the water-guiding component assembly in an interior of said outer housing, wherein a connection inside said outer housing between the connector of said unit not forming part of the water-guiding component assembly and the component is at least one of said connection interfaces.

3. The water-guiding component assembly according to claim 1, further comprising two separate components forming part of the water-guiding component assembly, one of said connection interfaces is configured between said two separate components disposed in said outer housing.

4. The water-guiding component assembly according to claim 1, further comprising a connection hose; and wherein said outer housing has a filter opening formed therein and, through said filter opening said connection hose is passed, with which said component in said outer housing is connected with said filter in a fluid-conducting way.

5. The water-guiding component assembly according to claim 1, further comprising at least two valves, which are disposed in said outer housing and at a respective one of said connection interfaces are connected to units not forming part of the water-guiding component assembly or to components forming part of the water-guiding component assembly.

6. The water-guiding component assembly according to claim 1, wherein said first housing part and second housing part, in an assembled state, bound an interior of said outer housing.

7. The water-guiding component assembly according to claim 6, wherein said first and second housing parts are connected in a non-destructively releasable manner.

8. The water-guiding component assembly according to claim 7, wherein said first and second housing parts are latched.

9. The water-guiding component assembly according to claim 6, wherein:

said second housing part has a second basic body; and said first housing part has a first basic body and a stop, said first housing part in a state connected to said second housing part with said first basic body up to said stop is fully inserted into said second basic body of said second housing part.

10. The water-guiding component assembly according to claim 9, wherein said first housing part has integrated therein at least one housing socket protruding in a tube-shaped manner from said first basic body, said housing socket having an end facing away from said first basic body with an opening formed in said end.

11. The water-guiding component assembly according to claim 10, wherein said outer housing has a cover cap disposed in a non-destructively releasable manner at said end of said housing socket facing away, and said cover cap having a cap opening formed therein that in comparison with said opening of said housing socket is reduced in cross-section.

12. The water-guiding component assembly according to claim 9, wherein said second basic body of said second housing part has integrated therein at least one housing socket protruding in a tube-shaped manner from said second basic body, said housing socket having an end facing away from said second basic body and said end having an opening formed therein.

13. The water-guiding component assembly according to claim 12, wherein said outer housing has a second cover cap, disposed in a non-destructively releasable manner on said end of said housing socket, which faces away, and said second cover cap has a cap opening formed therein that is reduced in cross-section in comparison with said opening of said housing socket.

14. The water-guiding component assembly according to claim 6, wherein said first housing part has at least one wall with an inner side;

wherein said second housing part has at least one wall; and further comprising positioning bars disposed on said inner side of said at least one wall of said first housing part integrated in an interior of said first housing part and/or on an inner side of said at least one wall of said second housing part integrated in an interior of said second housing part, said positioning bars for positioning a component forming part of the water-guiding component assembly.

15. The water-guiding component assembly according to claim 6, wherein said first and second housing parts each have at least one wall with an external surface; and further comprising at least one fastening element disposed on said external surface of said at least one wall of at least one of said housing parts for fastening the water-guiding component assembly on a unit not forming part of the water-guiding component assembly.

* * * * *